US005848222A

United States Patent [19]

Jung

[11] Patent Number: 5,848,222

[45] Date of Patent: Dec. 8, 1998

[54] APPLIANCE FOR DISPENSING WARM WATER HAVING AN AUXILIARY HEATER

[75] Inventor: Woong Jung, Suwon, Rep. of Korea

[73] Assignee: Daewoo Electronics Co., Ltd., Rep. of Korea

[21] Appl. No.: 821,581

[22] Filed: Mar. 18, 1997

[30] Foreign Application Priority Data

Mar. 18, 1996 [KR] Rep. of Korea ..... 1996-5111

[51] Int. Cl.[6] ..... F24H 1/20

[52] U.S. Cl. ..... 392/441; 392/447; 222/146.5

[58] Field of Search ..... 392/441, 442, 392/444, 445, 447; 137/341; 222/146.5

[56] References Cited

U.S. PATENT DOCUMENTS

| | | | |
|---|---|---|---|
| 2,745,572 | 5/1956 | Talbott | 222/146.5 |
| 2,912,142 | 11/1959 | Schultz | 222/146.1 |
| 3,239,649 | 3/1966 | Reeve | 222/146.5 |
| 3,546,429 | 12/1970 | Fleet et al. | 392/452 |
| 4,169,978 | 10/1979 | Hauslein | 392/442 |
| 4,730,099 | 3/1988 | Bleckman | 392/447 |
| 5,283,420 | 2/1994 | Montalto | 392/444 |
| 5,668,922 | 9/1997 | Ross et al. | 392/451 |

FOREIGN PATENT DOCUMENTS

3831152 A1 3/1990 Germany .

OTHER PUBLICATIONS

JP08005146 A, Published Jan. 12, 1996, Electric Water Heater for Domestic and Business Use–Has Auxiliary Heat Source Connected to Heat Exchanger Which Is Provided At Bottom of Heating Unit.

*Primary Examiner*—Teresa J. Walberg
*Assistant Examiner*—Jiping Lu
*Attorney, Agent, or Firm*—Cushman Darby & Cushman Intellectual Property Group of Pillsbury Madison & Sutro, LLP

[57] ABSTRACT

The appliance for dispensing warm and cold water has a heater for heating water in tank, a PTC heater for preliminarily heating newly supplied water in the tank toward a predetermined temperature, and a comparting member for forming a comparted space around the PTC heater. The comparting member is formed with a plurality of water flow apertures for communicating the comparted space with an inner space of the tank. When warm water in the tank is dispensed to outside, the same amount of water with the dispensed water is supplied in the tank. The newly supplied water is flowed into the inner surface of the tank after being heated by the PTC heater in the comparted space. Accordingly, the fall of temperature of warm water in the tank by the newly supplied water is prevented, and it is possible to dispense warm water having appropriate temperature at any time.

10 Claims, 3 Drawing Sheets

APPLIANCE FOR DISPENSING WARM WATER HAVING AN AUXILIARY HEATER

BACKGROUND OF THE INVENTION

1. Field of the Invention

The present invention relates to an appliance for dispensing warm water having an auxiliary heater for preliminarily heating water flowed into a tank, and more particularly to an appliance for dispensing warm water having a PTC (positive temperature coefficient) heater besides a heater for heating water accommodated in a tank so that newly flowed water into a tank may be mixed in warm water previously stored in the tank after being heated to a predetermined temperature.

2. Prior Art

FIGS. 2 and 3 show a conventional appliance for dispensing warm water, and especially show a conventional appliance for dispensing warm water and cold water. Generally, in appliance for dispensing warm and cold water, the cold water is generated by a cooling system as shown in FIG. 2. The cooling system has a compressor 105 for compressing a refrigerant such as Freon, a condenser 116 for condensing the refrigerant supplied from the compressor 105 into liquid state, and an evaporator 109 for generating cool air by evaporating the refrigerant supplied from the condenser 116. The refrigerant evaporated in the evaporator 109 circulates into the compressor 105 through a pipe 107, and the compressor 105 compresses the evaporated refrigerant again. By such a cooling system, the cool air is generated at the evaporator 109.

The appliance 101 has a cold water tank 103 for storing water supplied from exterior in order to generate cold water, and a warm water tank 125 storing water supplied from the cold water tank 103 in order to generate warm water. In the cold water tank 103, a plate 102 for partitioning the inner space of the cold water tank 103 into an upper space and a lower space is installed. The water supplied into the cold water tank 103 is flowed into the lower space of the cold water tank 103 through the upper space of the cold water 103. The lower outer surface of the cold water tank 103 is wound with the evaporator 109, and accordingly water in the lower space of the cold water tank 103 is cooled by the evaporator 109. A pipe 113 for dispensing cold water is connected to the cold water tank 103, and a cold water valve 117 is installed at the end of the cold water dispensing pipe 113. When a user operates the cold water valve 117, the water in the cold water tank 103 is dispensed to outside.

The cold water tank 103 and the warm water tank 125 are connected with each other by a supplying pipe 123. The supplying pipe 123 communicates the upper space of the cold water tank 103 and the inner space of the warm water tank 125. Accordingly, the water accommodated in the upper space of the cold water tank 103 is supplied into the warm water tank 125 through the supplying pipe 123.

A heater 126 for heating the water accommodated in the warm water tank 125 is installed in the warm water tank 125, and a bimetal switch 131 for controlling the heater 126 is mounted on an outer surface of the warm water tank 125. The bimetal switch 131 performs switching operation according to the temperature of water in the warm water tank 125 so as to control the supply of electric power to the heater 126, and accordingly the water in the warm water tank 125 maintains a predetermined temperature. A pipe 115 for dispensing warm water is connected to the warm water tank 125, and a warm water valve 127 is installed at the end of the warm water dispensing pipe 115. When a user operates the warm water valve 127, the water in the warm water tank 125 is dispensed to outside, and the same amount of water with the amount of the dispensed water out of the warm water tank 125 is flowed from the cold water tank 103 into the warm water tank 125 through the supply pipe 123.

The newly flowed water is mixed in the water previously stored in the warm water tank 125, and thus the temperature of water in the warm water tank 125 is lowered. The bimetal switch 131 drives the heater 127 as sensing that situation, and the temperature of water in the warm water tank 125 begins to rise toward the predetermined temperature again. Accordingly, the water in the warm water tank 125 is maintained at an appropriate temperature.

However, such a conventional appliance for dispensing warm and cold water has a problem that it is difficult to keep the temperature of water in the warm water tank 125 constant when the amount of dispensed water is great. That is, when the amount of dispensed water is great, lots of water is flowed into the warm water tank 125 in a short time, and accordingly, despite the heating operation of the heater 126, the temperature of water in the warm water tank 125 does not rise rapidly. Thus, it takes long time to recover normal temperature of warm water.

SUMMARY OF THE INVENTION

The present invention has been proposed to overcome the above described problems in the prior art, and accordingly it is an object of the present invention to provide an appliance for dispensing warm water in which the temperature of warm water in the warm water tank does not fall down rapidly even when the amount of dispensed water is great so that it is possible to dispense warm water with stable temperature.

To achieve the above object, the present invention provides an appliance for dispensing warm water comprising: a tank being connected with a supply pipe for supplying water from exterior and a dispensing pipe for dispensing water stored therein to exterior, said tank for storing water supplied through said supply pipe; a main heating means for heating water stored in said tank; a means for controlling said main heating means, said controlling means performing a switching operation according to a temperature of water in said tank so that a temperature of the water in said tank maintains a predetermined temperature; and an auxiliary heating means for heating disposed adjacently to an inflow opening of said supply pipe which is opened inside said tank so that a temperature of water flowed into said tank through said supply pipe is reached the predetermined temperature.

Here, it is preferable that the appliance further comprises a comparting member for surrounding said auxiliary heating means and the inflow opening so as to form a predetermined comparted space around said auxiliary heating means and the inflow opening, said comparting member being formed with a plurality of water flow apertures communicating the comparted space with an inner space of said tank. Accordingly, it is possible to achieve better effect that the newly flowed water is mixed in the previously stored water in the tank after being heated to the predetermined temperature.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Figure 1:
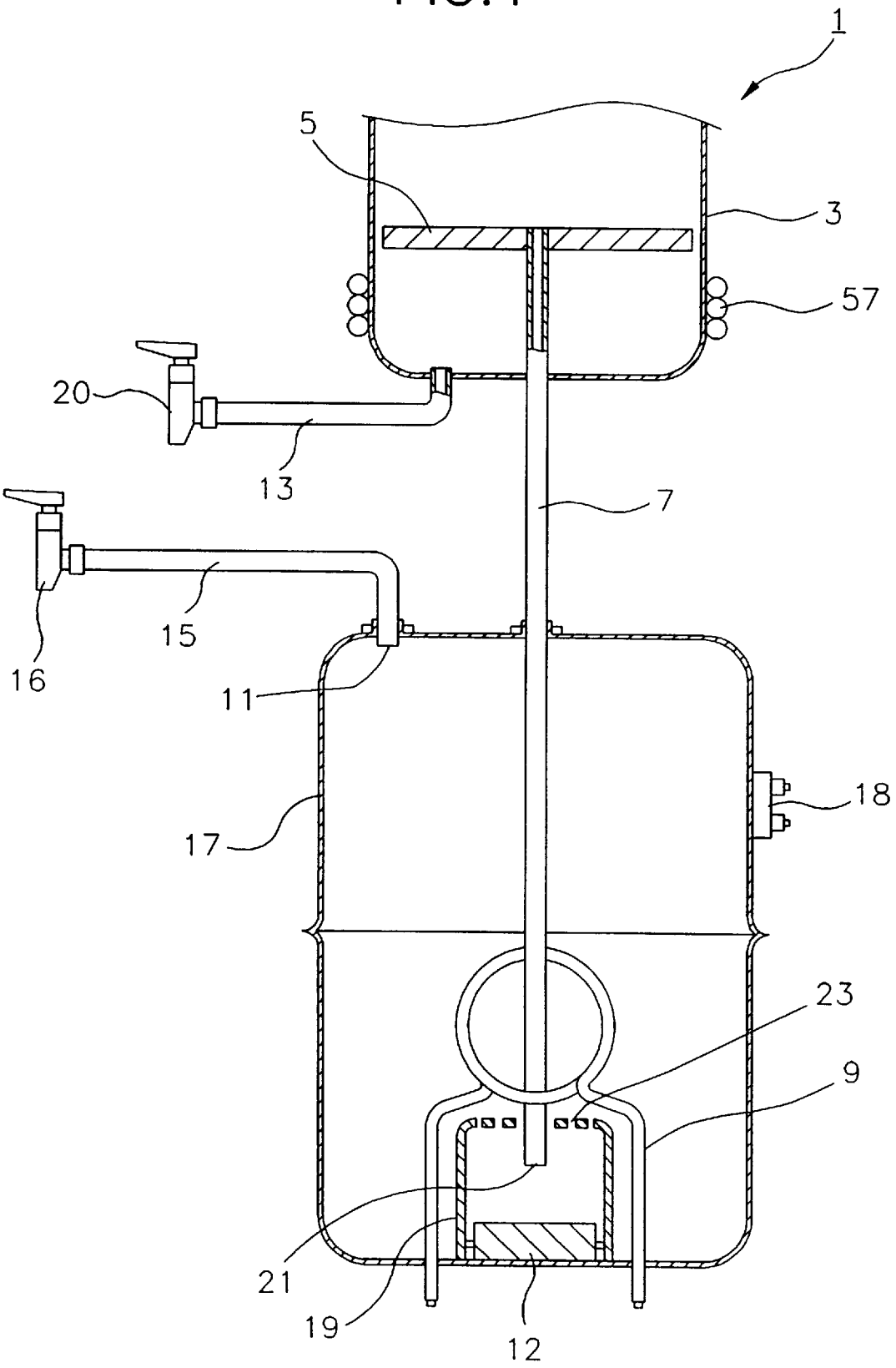
FIG. 1 is a schematic sectional view of an appliance for dispensing warm and cold water according to the present invention.
Figure 2:
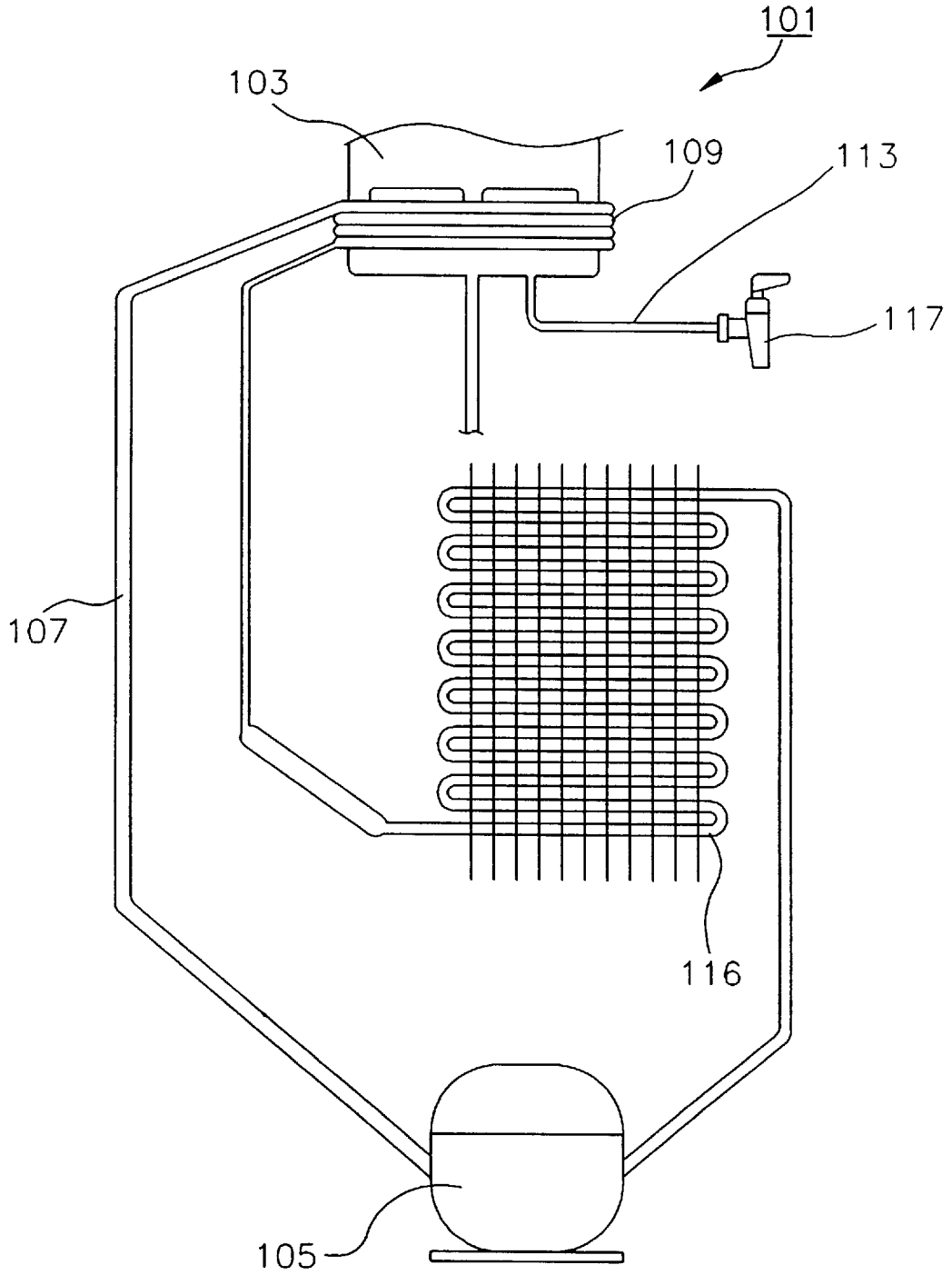
FIG. 2 PRIOR ART
FIG. 2 is a schematic view of a cooling system of a conventional appliance for dispensing warm and cold water.
Figure 3:
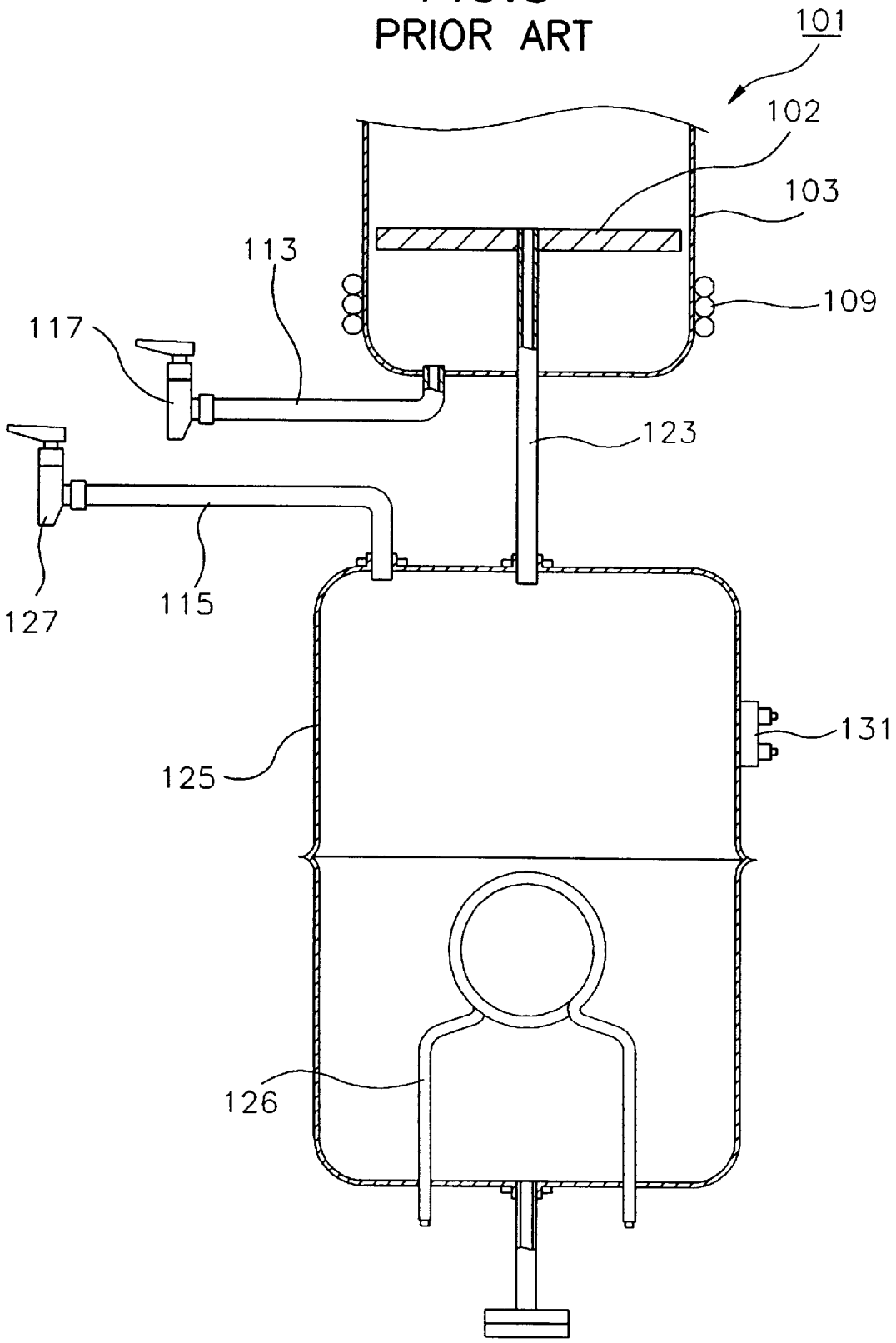
FIG. 3 PRIOR ART
FIG. 3 is a schematic sectional view of a conventional appliance for dispensing warm and cold water.

Hereinafter, the present invention will be described in detail with reference to the drawings. The same parts with the conventional appliance as shown in FIGS. 2 and 3 will be described in a rough manner.

The appliance 1 for dispensing warm and cold water has a cold water tank 3 and a warm water tank 17. In the cold water tank 1 is installed a plate 5 for partitioning the inner space of the cold water tank 1 into an upper space and a lower space. The lower outer surface of the cold water tank 3 is wound with the evaporator 57, and accordingly cold water is generated in the lower space of the cold water tank 3. A cold water dispensing pipe 13 is connected to the cold water tank 3, and a cold water valve 20 for dispensing the cold water to outside is installed at the end of the cold water dispensing pipe 13.

The upper space of the cold water tank 3 and the inner space of the warm water tank 17 are communicated with each other by a supplying pipe 7. The supply pipe 7 is extended downward in the warm water tank 17 so that an inflow opening which is opened inside the warm water tank 17 is opened at an area adjacent to the bottom surface in the warm water tank 17.

In the warm water tank 17, a heater 9 is installed as a main means for heating the water accommodated in the warm water tank 17, and on an outer surface of the warm water tank 17, a bimetal switch 18 for controlling the heater 9 is mounted. The bimetal switch 18 performs switching operation according to the temperature of water in the warm water tank 17 so as to control the supply of electric power to the heater 9.

On the bottom surface of the warm water tank 17, a PTC heater 12 is installed as an auxiliary means for heating the newly flowed water into the warm water tank 17. The PTC heater 12 is a heater made of a PTC (Positive Temperature Coefficient) element which is mainly consists of Bariumtitanate. The PTC heater 12 has a switching temperature which is capable of being set arbitrarily according to the composition of component materials. The PTC element has a characteristic that the electrical resistance thereof increases precipitously at the switching temperature. Thus, the PTC element has the characteristic that the current flows therethrough well at a low temperature but hardly flows at a higher temperature than the switching temperature. If a certain voltage is applied to the PTC heater 12, the PTC heater 12 begins to radiate heat by a current flowed therethrough and initial resistance thereof. If the temperature of the PTC heater 12 reaches the switching temperature by the radiated heat, the current become reduced since the resistance of the PTC increases precipitously. Accordingly, the current is cut off at the switching temperature, so the heat is not radiated any more. If the temperature falls again, the electrical resistance of the PTC heater 12 decreases, and accordingly the heat is radiated again by the current. As such a process is repeated, the ambient of the PTC heater 12 maintains approximately the switching temperature. In the appliance according to the present invention, the switching temperature is set between 85 centigrade and 120 centigrade. Such a range of temperature is common temperature used in general appliance for dispensing warm water, and as aforementioned, the switching temperature in such a range can be set easily according to the composition of component materials of the PTC element.

The PTC heater 12 is disposed adjacently to the inflow opening 21 of the supply pipe 7. At the lower area of the warm water tank 17, a comparting member for surrounding the PTC heater 12 and the inflow opening 21 is mounted. The comparting member 19 forms a predetermined space around the PTC heater 12 and the inflow opening 21 which is comparted from the inner space of the warm water tank 17. The comparting member 19 is formed with a plurality of water flow apertures 23 which communicate the comparted space with the inner space of the warm water tank 17.

A pipe 15 for dispensing warm water is connected to the upper part of the warm water tank 17, and a warm water valve 16 for dispensing the warm water to outside is installed at the end of the warm water dispensing pipe 15. A dispensing opening 11 of the warm water dispensing pipe 15 which is opened inside the warm water tank 17 is disposed at the upper area of the warm water tank 17 so as to be maximally distanced from the inflow opening 21.

Hereinbelow, the operation and effect of the appliance for dispensing warm and cold water according to the present invention will be described.

Water accommodated in the lower space of the cold water tank 3 is cooled by the evaporator 57, and water accommodated in the warm water tank 17 is maintained at a predetermined temperature by the heater 9 and the bimetal switch 18. When a user operates the warm water valve 16, the water in the warm water tank 17 is dispensed to outside through the warm water dispensing pipe 15, and the same amount of water with the amount of the dispensed water out of the warm water tank 17 is flowed from the the upper space of the cold water tank 3 into the warm water tank 17 through the supply pipe 7. During that situation, as the inflow opening 21 of the supply pipe 7 is opened at the area adjacent to the bottom surface of the warm water tank 17, the water flowed in is supplied into the lower area of the warm water tank 17.

The supplied water is accommodated in the comparted space formed by the comparting member 19, and heated by the PTC heater 12 toward the switching temperature. The heated water is flowed out little by little through the water flow apertures 23 so as to be mixed in the water previously stored in the warm water tank 17. Since the newly flowed water into the warm water tank 17 is not directly mixed in the warm water previously stored in the warm water tank 17 but mixed after being heated by the PTC heater 12, the sudden fall of the temperature of water in the warm water tank 17 is prevented.

Moreover, as the inflow opening 12 and the dispensing opening 11 are distanced maximally with each other, although the amount of consumption of the warm water suddenly increases, the newly supplied water is dispensed last and accordingly the dispensing of warm water can be stabler. Furthermore, since the inflow opening 12 is positioned at the lower area in the warm water tank 17 and the dispensing opening 11 is positioned at the upper area in the warm water tank 17, the newly supplied water which has smaller weight per quantity than that of the water previously stored in the warm water tank 17 is accommodated in the lower part in the warm water tank 17, and accordingly the efficiency that the newly supplied water is mixed in the water in the warm water tank 17 after being preliminarily heated becomes more outstanding.

As described above, according to the present invention, the temperature of warm water in the warm water tank does not fall down suddenly even when the amount of dispensing of warm water suddenly increases and it is possible to dispense warm water having appropriate temperature at any time.

Although the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. An appliance for dispensing warm water comprising:

a tank for storing water, a supply pipe for supplying water from exterior to said tank, and a dispensing pipe for dispensing water from said tank to exterior, in which the supply pipe is connected to a portion of an upper wall of said tank and has an inflow opening extended to an inside of said tank, and the dispensing pipe is connected to another portion of the upper wall of said tank and has a water valve extended to an outside of said tank;

a main heating means for heating water stored in said tank;

a means for controlling said main heating means, said controlling means performing a switching operation according to a temperature of water in said tank so that a temperature of the water in said tank maintains a predetermined temperature;

an auxiliary heating means for heating water which is disposed at a lower part of the tank; and a comparting member for surrounding said auxiliary heating means such that said comparting member divides the tank into a comparted outside space in which the main heating means is disposed and a comparted inside space in which the auxiliary heating means is disposed, the inflow opening of the supply pipe being connected with an upper part of said comparted inside space so that water supplied through the supply pipe from exterior flows out of said supply pipe, downwardly in said comparted inside space, and the comparting member having a plurality of water flow apertures to communicate the comparted outside space and the comparted inside space of the tank.

2. The appliance for dispensing warm water as claimed in claim 1, wherein said auxiliary heating means is a PTC heater.

3. The appliance for dispensing warm water as claimed in claim 2, wherein a switching temperature of said PTC heater is set between 85 centigrade and 120 centigrade.

4. The appliance for dispensing warm water as claimed in claim 1, wherein said controlling means is a bimetal switch mounted on an outer surface of said tank.

5. The appliance for dispensing warm water as claimed in claim 1, wherein said auxiliary heating means is disposed to be maximally distanced from a dispensing opening of said dispensing pipe which is opened inside said tank.

6. The appliance for dispensing warm water as claimed in claim 5, wherein the dispensing opening is positioned at an upper part of said tank, and said auxiliary heating means is positioned at a lower part of said tank.

7. An appliance for dispensing warm water comprising:

a tank for storing water, a supply pipe for supplying water from exterior to said tank, and a dispensing pipe for dispensing water stored therein from said tank to exterior, in which the supply pipe is connected to a portion of an upper wall of said tank and has an inflow opening extended to an inside of said tank, and the dispensing pipe is connected to another portion of the upper wall of said tank and has a water valve extended to an outside of said tank;

a first heater for heating water stored in said tank;

a bimetal switch mounted on an outer surface of said tank, said bimetal switch for controlling said first heater by performing a switching operation according to a temperature of water in said tank so that a temperature of the water in said tank maintains a predetermined temperature;

a PTC heater disposed adjacently to an inflow opening of said supply pipe for heating water which is disposed at a lower part of the tank; and a comparting member for surrounding said PTC heater such that said comparting member divides the tank into a comparted outside space in which the first heater is disposed and a comparted inside space in which the PTC heater is disposed, the inflow opening of the supply pipe being connected with an upper part of said comparted inside space so that water supplied through the supply pipe from exterior flows out of said supply pipe, downwardly in said comparted inside space, and the comparting member having a plurality of water flow aperatures to communicate the comparted outside space and the comparted inside space of the tank.

8. The appliance for dispensing warm water as claimed in claim 7, wherein a switching temperature of said PTC heater is set between 85 centigrade and 120 centigrade.

9. The appliance for dispensing warm water as claimed in claim 7, wherein said PTC heater is disposed to be maximally distanced from a dispensing opening of said dispensing pipe which is opened inside said tank.

10. The appliance for dispensing warm water as claimed in claim 9, wherein the dispensing opening is positioned at an upper part of said tank, and said PTC heater is positioned at a lower part of said tank.

* * * * *